United States Patent [19]

Chihara

[11] 4,395,138

[45] Jul. 26, 1983

[54] ELECTRONIC TIMEPIECE

[75] Inventor: Hiroyuki Chihara, Suwa, Japan

[73] Assignee: Kabushiki Kaisha Suwa Seikosha, Tokyo, Japan

[21] Appl. No.: 266,674

[22] Filed: May 22, 1981

[30] Foreign Application Priority Data

May 22, 1980 [JP] Japan ..... 55-68221
May 22, 1980 [JP] Japan ..... 55-68222
May 22, 1980 [JP] Japan ..... 55-68223

[51] Int. Cl.[3] ..... G04B 1/00
[52] U.S. Cl. ..... 368/204; 368/66
[58] Field of Search ..... 368/200–204, 368/66, 60

[56] References Cited

U.S. PATENT DOCUMENTS 3,999,368 12/1976 Yoshida ..... 58/23 BA
4,094,137 6/1978 Morokawa ..... 58/23 A
4,226,081 10/1980 Ichikawa ..... 368/66
4,298,971 3/1981 Morokawa et al. ..... 368/202

FOREIGN PATENT DOCUMENTS 2079498 1/1982 United Kingdom ..... 368/66

*Primary Examiner*—Bernard Roskoski
*Attorney, Agent, or Firm*—Blum, Kaplan, Friedman, Silverman & Beran

[57] ABSTRACT

Energy is conserved and the life of a lithium battery is extended in a timepiece by using a voltage reduction circuit for normal operation and a voltage regulating circuit during periods of heavy current drain, e.g., alarm or lamp function. A no-clock detector indicates the functional status of the timekeeping standard signal generator and voltage is raised to enable self-starting when oscillator signals are absent. A timer holds the regulated voltage on-line until operations stabilize after a period of heavy load and capacitors used in the voltage reduction circuit bolster the regulated voltage output during high load periods.

16 Claims, 5 Drawing Figures

ELECTRONIC TIMEPIECE

BACKGROUND OF THE INVENTION

This invention relates generally to an electronic timepiece which is highly energy efficient and more particularly to an electronic timepiece which adjusts its voltage supply level to match the condition of operation. In recent years, the performance of a lithium battery has been improved and designers are beginning to use these batteries in an electronic timepiece. Also, because of the increasing price of silver, a lithium battery for use in a timepiece is attracting attention.

A lithium battery usually outputs a 2.8 to 3.0 voltage level, and has capacity for use in a timepiece of 60 to 100 milliampere hours at three volts. However, with regard to C-MOS integrated circuits for use in a wristwatch, it is generally known that the integrated circuit operates satisfactorily at 1.5 volts. Energy is wasted when the circuits operate from the three volt level of a lithium battery. Battery life is extended by operating with a half voltage, that is, approximately 1.5 volts, by using a circuit in conjunction with the lithium battery which switches the connection of two capacitors so they are alternately in series or in parallel.

Thus, the lithium battery is advantageously used at half voltage, and because of its low self-discharge rate characteristic, a wristwatch using a lithium battery can have a life of 5 to 7 years without battery change. However, in actual practice of using a lithium battery for a wristwatch, there is a problem in that the internal resistance of the lithium battery is very large. This is particularly true regarding a flat and small lithium battery as would be desirable for a wristwatch. Therefore, such a battery is not suitable for a wristwatch having heavy load circuits, for example, a lamp or an alarm circuit because of a significant internal voltage drop.

What is needed is an electronic timepiece having a power source which provides a stable voltage output during normal operation as well as during periods of heavy load.

SUMMARY OF THE INVENTION

Generally speaking, in accordance with the invention, an electronic timepiece especially suitable to provide extended battery life is provided. Energy is conserved and the life of a lithium battery is extended in a timepiece by using a voltage reduction circuit for normal operation and a voltage regulating circuit during periods of heavy current drain, e.g., alarm or lamp function. A no-clock detector indicates the functional status of the timekeeping standard signal generator and voltage is raised to enable self-starting when oscillator signals are absent. A timer holds the regulaed voltage on-line until operations stabilize after a period of heavy load and capacitors used in the voltage reduction circuit bolster the regulated voltage output during high load periods.

Accordingly, it is an object of this invention to provide an improved electronic timepiece efficiently adapted to use a lithium battery of comparatively high voltage and high internal resistance.

Another object of this invention is to provide an improved electronic timepiece which performs its timekeeping function in a stable manner even when supplemental circuits cause a heavy load on the power supply.

A further object of this invention is to provide an improved electronic timepiece which provides a stable voltage output when supplemental circuits place a heavy current load on the system.

Still another object of this invention is to provide an improved electronic timepiece which enables self-starting of the timekeeping oscillator circuit when a new battery is inserted.

Yet another object of this invention is to provide an improved electronic timepiece which varies its power supply so as to operate at maximum efficiency for every condition of operation.

A further object of this invention is to provide an improved electronic timepiece which uses capacitor elements of an unregulated voltage source to reinforce performance of a regulated voltage source.

Still another object of this invention is to provide an improved electronic timepiece which raises the level of power supply voltage when oscillator output signals are absent.

Still other objects and advantages of this invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings of in which.

DESCRIPTION OF THE PREFERRED EMBODIMENTS

Figure 1:
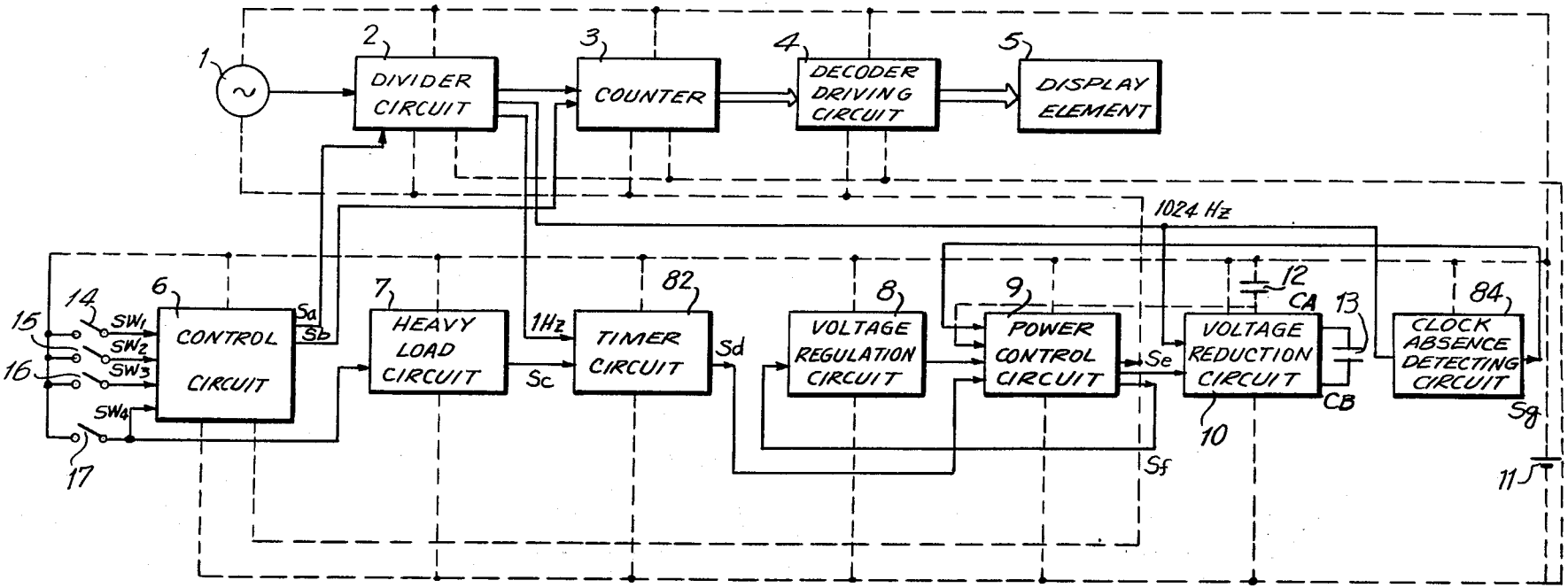
FIG. 1 is a functional block diagram of an electronic timepiece in accordance with this invention.

Herein, power circuits which offer stable constant voltage to a timekeeping circuit block are described. The stable voltage outputs are provided even when battery voltage fluctuates due to the application of a circuit drawing a heavy current load. With reference to FIG. 1, an electronic timepiece structure in accordance with this invention includes a time standard source 1 such as a quartz crystal oscillator, a binary divider circuit 2, a counter circuit 3 for counting signals of seconds, minutes and hours, etc., a decoder and display driving circuit 4, and display means 5 such as a panel including liquid crystals. A control circuit 6 receives signals from control switches 14–17 and controls the non-automatic functions of the timekeeping circuit block. Also included is a heavy load circuit 7 such as a lamp or a buzzer, and a power source 11. Assuming that the power source 11 is a lithium battery having a voltage of 3 V, different voltage levels as described fully hereinafter are defined as follows:

$$V_{DD}=0\text{ V},\ V_{SS2}=-3\text{ V},\ V_{SS1}=\text{approx. }-1.5\text{ V}$$

In FIG. 1, power lines $V_{DD}$, $V_{SS2}$ and $V_{SS1}$ are shown in broken lines and solid lines indicate lines carrying signals. A voltage reduction circuit 10 reduces the battery voltage by ½ of the battery voltage by switching a connection of capacitors 12,13 so that the capacitors are either in series or in parallel. A voltage regulation circuit 8 outputs a constant voltage even when the voltage of the power source 11 changes. This regulated voltage is established at the same magnitude of output voltage as is the voltage reduction circuit 10, that is, close to 1.5 V which is ½ of the battery voltage.

A power control circuit 9 normally stops operation of the voltage regulation circuit 8 and drives the voltage reduction circuit 10. Thereby, reduced voltage $V_{SS1}$ is supplied from the reduction circuit 10. On the other hand, when a heavy load circuit 7 operates, for example, a lamp is turned on, the power control circuit 9 stops operation of the voltage reduction circuit 10 and actuates the voltage regulation circuit 8. Then, a stable value of voltage $V_{SS1}$ is outputted from the voltage regulation circuit 8.

The losses due to operation of the voltage regulation circuit 8 are larger than the losses associated with operation of the voltage reduction circuit 10. Therefore, the voltage regulation circuit 8 is not generally driven to supply a stable voltage $V_{SS1}$ other than at those times when a heavy current load is on the line. In particular, the voltage reduction circuit 10 has very little in the way of internal losses because it operates by a changeover in connection of capacitors 12,13. That is, these capacitors 12,13 are connected alternately in series or in parallel. But where the voltage regulation circuit 8 reduces voltage from the battery, the loss is comparatively large because, as described later herein, the voltage is reduced by using a voltage drop of a MOS transistor to obtain the stable output voltage. Therefore, for normal operations, the voltage $V_{SS1}$ is outputted from the voltage reduction circuit 10 which reduces voltage with good efficiency. When the voltage has to be stabilized, that is, under a heavy current load, the voltage reduction circuit is inadequate and the voltage regulation circuit 8 is driven to supply the required stabled voltage $V_{SS1}$.

In FIG. 1, a timer circuit 82 has the function of driving the voltage regulation circuit 8 for a pre-established period of time after a heavy load circuit is no longer driven. The voltage regulation circuit 8 is maintained on-line as the power source for this extended period of time because a little time is required until the battery recovers after a period of operation under heavy current load.

As shown in FIG. 1 a signal of 1024 Hz is inputted to the voltage reduction circuit 10. When a battery 11 is set into the circuit, no clock pulses of 1024 Hz are fed to the voltage reduction circuit 10 and therefor for reduced voltage output $V_{SS1}$ is not produced. It is necessary to initiate oscillation in the oscillator circuit. When a detecting circuit 84 for detecting the existence of a clock pulse of 1024 Hz detects that there is, in fact, no clock pulse, a signal is provided to a power control circuit 9 which actuates the voltage regulation circuit 8 automatically. Thereby, a power source voltage $V_{SS1}$ is provided even though there is no oscillation or 1024 Hz signal. The voltage regulation circuit 8 operates without a clock pulse as described hereinafter.

Figure 2:
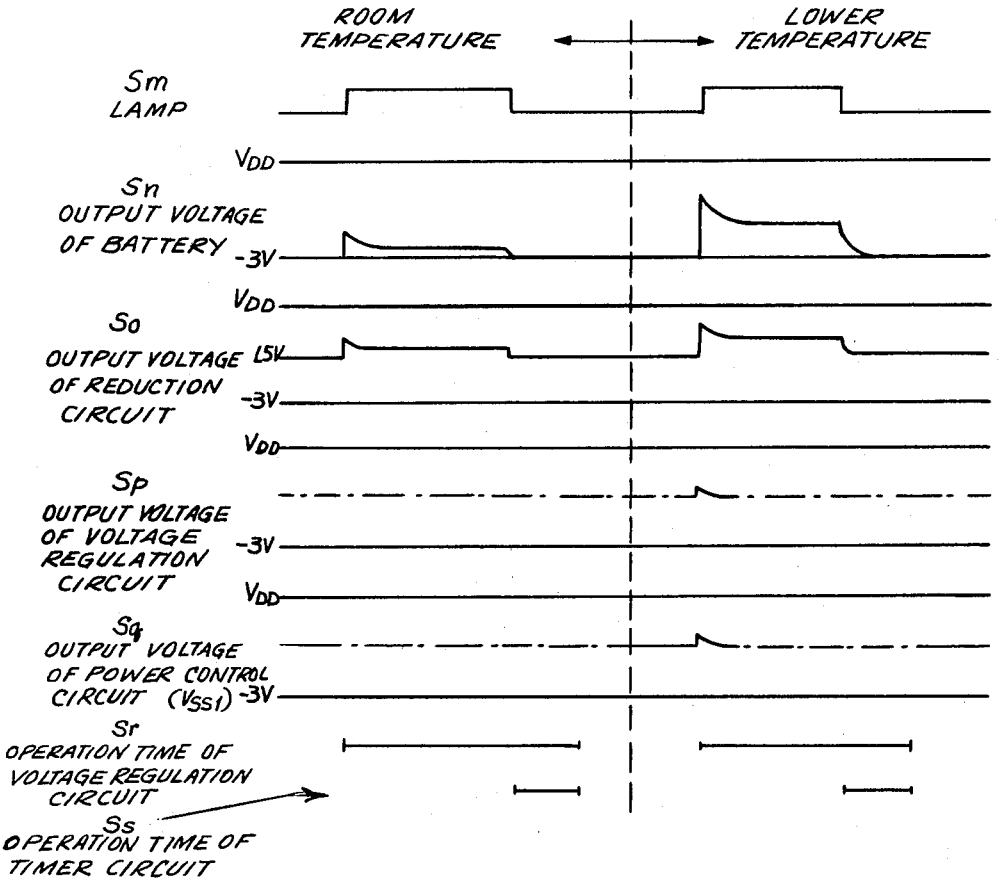
FIG. 2 shows waveforms associated with the functional block diagram of FIG. 1.

FIG. 2 presents voltage waveforms from the main power sources based upon the block diagram of FIG. 1. A lithium battery is used as a power source 11. Open circuit voltage is 3 V and the internal resistance of the battery 11 is approximately 50 to 80 at room temperature and about 150 to 200Ω at −10° C. In this instance, a lamp represents the heavy load circuit. In FIG. 2, voltage waveforms at room temperature are illustrated on the left and those at a lower temperature are illustrated on the right side of the drawing.

A lamp signal Sm is provided by operation of a switch 17-$S_{W4}$ (FIG. 1). The output voltage Sn is the output level of the lithium battery 11 showing voltage reduction when the lamp is turned on. The output voltage of the reduction circuit 10 is identified as So, and the output voltage of the voltage regulation circuit 8 is identified Sp. The output voltage of the power control circuit 9 is identified as Sq. These waveformes Sn-Sq are shown relative to the voltage $V_{DD}$. For convenience in explanation, So and Sp are represented as output voltages under the condition of driving circuits continuously without regard to the existence of a heavy load.

As shown in the waveform Sn (FIG. 2), when the lamp is turned on, an inrush current is supplied to the lamp and battery voltage drops to about 2 volts at room temperature and to about 1.3 volts at the lower temperature as compared to the 3 volts under normal load. This voltage pattern results even when a resistor of 150Ω or so is used in series with the lamp to decrease the inrush current. Thus, unless countermeasures are considered, the battery voltage drops to 1 V or less.

The output voltage So of the voltage reduction circuit 10 is approximately half of the battery voltage when the circuit comprising capacitors 12,13 is driven. As shown in the waveform So, the output voltage of the voltage reduction circuit 10 reduces to approximately 0.6 V at the lower temperature, such that circuits requiring a voltage $V_{SS1}$ cannot be successfully driven. One method to compensate for such a battery voltage reduction which can be considered is that the output voltage from a voltage reduction circuit is used as $V_{SS1}$ for normal operation and under a heavy load the battery voltage itself is supplied as $V_{SS1}$. However, in using such a technique battery voltage remains largely dependent upon changes in temperature. Under heavy load, the power source voltage $V_{SS1}$ is a variable as battery voltage changes and as a result this will be a principal cause of erroneous operations. For example, with rapid voltage changes a counter in the timekeeping circuits may count incorrectly or may be reset. Also, when the heavy load circuit is driven at a high temperature, the battery voltage is not reduced very much and as a result a voltage of about 3 V is supplied as $V_{SS1}$. Under such a condition it is possible that a quartz crystal oscillator circuit resonates with an overtone. Thus, when the battery is used directly or when a voltage regulation circuit 10 using switched capacitors is used, there is a problem due to high loads and varying ambient temperatures.

In contrast to the above erratic performance, the output voltage of the voltage regulation circuit 8 remains constant as long as the battery voltage is high than the preselected value of output voltage used for the voltage regulation circuit 8. Should the battery voltage fall below the preselected value, the actual battery voltage itself is supplied as the output of the voltage regulation circuit 8. This characteristic is illustrated in FIG. 2 by the voltage waveform Sp. A broken line has a constant value except for a dip in voltage at the one extreme at the lower temperature where the battery voltage Sm reaches its minimum magnitude.

As stated above, during normal operation, the voltage reduction circuit 10 is driven to provide an output voltage but at the time of heavy load, the output voltage is provided by the voltage regulation circuit 8 due to operation of the power control circuit 9 which switches operations between the two sources. The output voltage $V_{SS1}$ is identified as Sq in FIG. 2. In the waveform Sq, the solid line portion represents the output voltage from the voltage reduction circuit 10, and the broken portion of the line represents the output voltage from the voltage regulation circuit 8.

In FIG. 2, Sr indicates the operational time of the voltage regulation circuit 8 in providing the output voltage. The operation times Ss of the timer circuit 82 measure a fixed period of time following termination of a heavy load circuit operation. The periods Ss occur at the termination of lamp operation Sm indicated in FIG. 2. This gives time for the battery voltage to completely recover during operation of the timer circuit 82 after the heavy load circuit is released from operation. It is only after the time period Ss, when the battery voltage is fully recovered, that the voltage output is switched from the voltage regulation circuit 8 back to the voltage reduction circuit 10. In the waveform Sq, there is an instantaneous reduction in the voltage magnitude at the one point where the battery voltage is actually lower than the constant voltage which the voltage regulation circuit 8 is designed to maintain. However. a voltage of approximately 1.3 V, at which the timekeeping circuits are driven without malfunction, can be achieved by inserting a resistor in series with the lamp, or by selecting a lamp with suitable instantaneous current characteristics when it is energized.

As stated above, by means of the power control circuit 9, the voltage reduction circuit 10 with capacitors 12,13 normally operates so as to provide a reduced voltage $V_{SS1}$, with a voltage reduction efficiency approximating one-hundred percent. At the time of setting or releasing a heavy load circuit, when the battery voltage changes greatly, the voltage regulation circuit 8 and a time circuit 82, respectively actuate so as to supply a stable voltage $V_{SS1}$.

Figure 3:
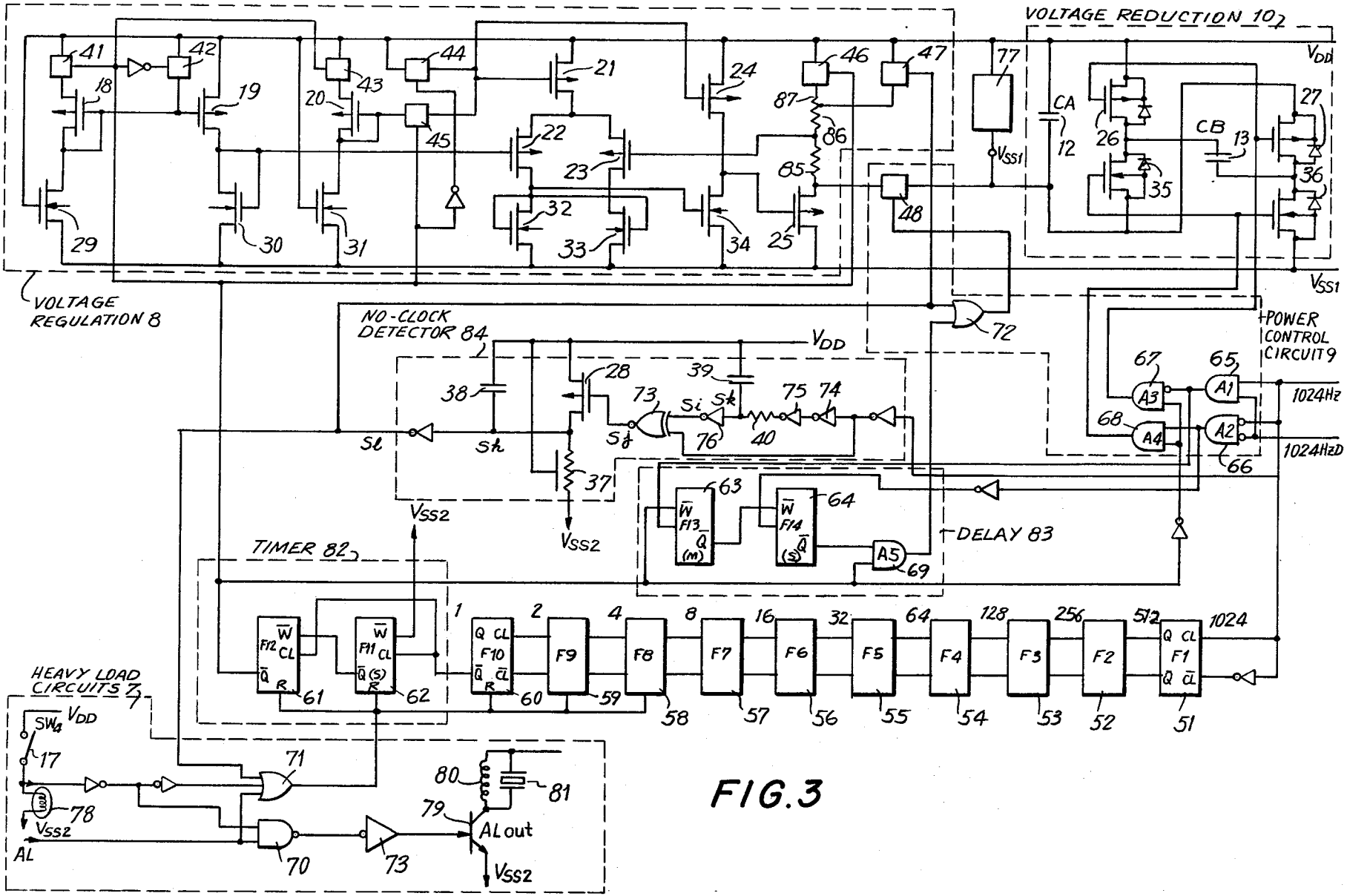
FIG. 3 is a schematic diagram of the power circuits of the electronic timepiece of FIG. 1.
Figure 4:
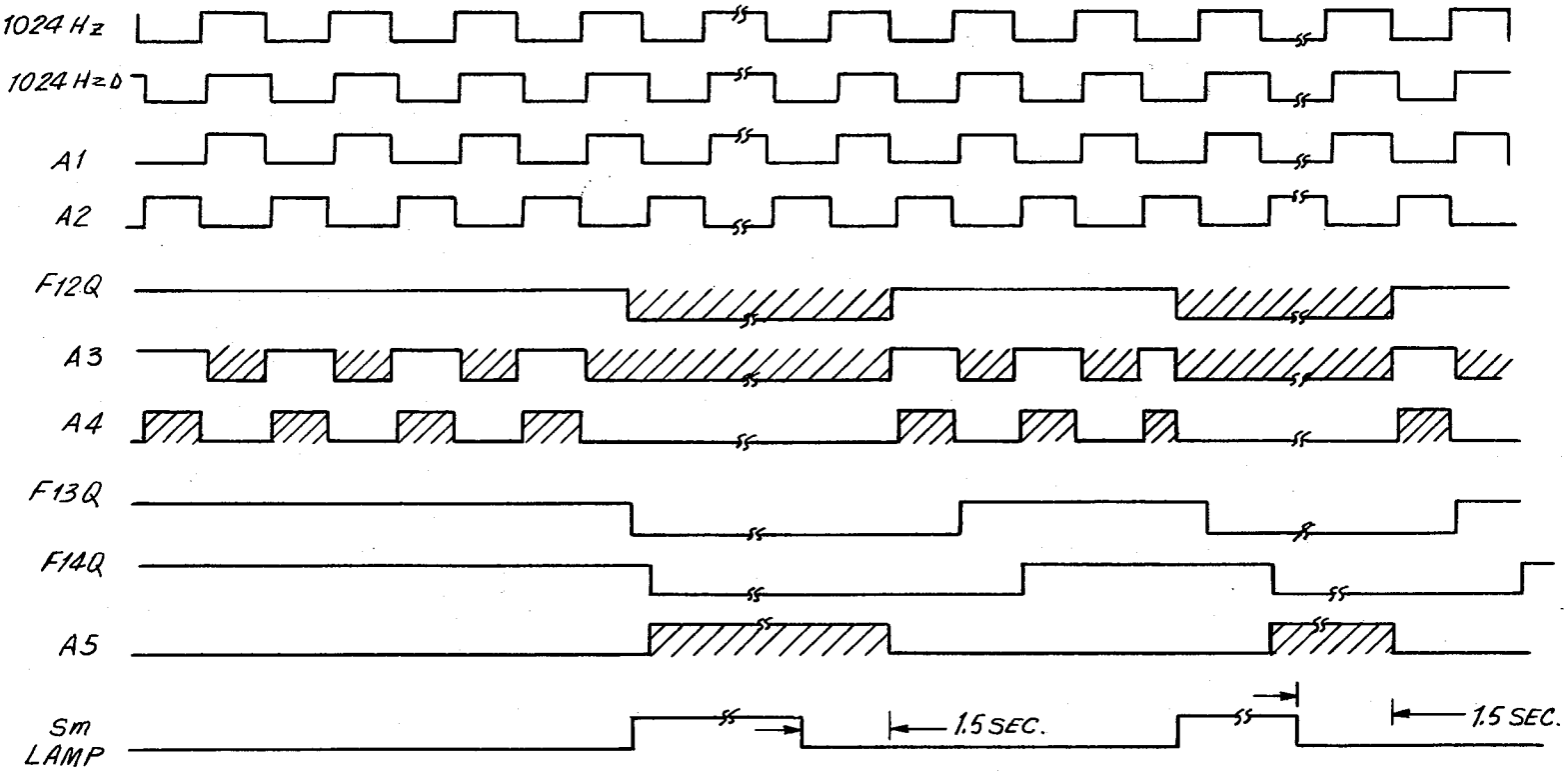
FIG. 4 shows timing waveforms associated with the circuit diagram of FIG. 3.

A schematic diagram of the power circuits for an electronic timepiece in accordance with this invention is illustrated in FIG. 3 and a timing chart associated with FIG. 3 is presented in FIG. 4. In FIG. 3, the block 8, enclosed with a broken line corresponds to the voltage regulation circuit 8 of FIG. 1. Similarly, blocks 9,10,7,82 and 84 correspond to the power control circuit 9, voltage reduction circuit 10, heavy load circuit 7, timer circuit 82 and no-clock detecting circuit 84, respectively. The block 83 (FIG. 3) is a portion of the power control circuit 9 and comprises a delay circuit as explained more fully hereinafter.

In FIG. 3, the circuit includes P-type MOSFET transistors 18–28. Only transistor 25 is of the depletion type and the other transistors are of the enhancement type. Transistors 29–37 are N-type MOSFETS of the enhancement type. Switching gates 41–48 conduct when gate potential is high and do not conduct when gate potential is low. All of the gates and flip-flops of FIG. 3 other than those described above are C-MOSFETS. Capacitors 38,39 and resistors 40,85–87 are part of the integrated circuitry. Flip-flops 51–61 are master-slave. Half flip-flops 62,64 are of the slave type and half flip-flop 63 is of the master type. All of the flip-flops are in a writing condition when a clock signal is high in the master flip-flops, and when a clock signal is low in the slave flip-flops. The circuit elements which are not formed by integrated circuitry, that is, outside of the integrated circuit, are a lamp lighting switch ($Sw_4$) 17, a lamp 78, a NPN transistor 79 for driving an alarm circuit, an inductance coil 80 for the alarm circuit, a piezoelectric element 81, and capacitors 12,13 of approximately 0.1 $\mu$F, which are used for reducing voltage in the voltage reduction circuit 10.

Two signals of 1024 Hz are supplied to the circuit of FIG. 3. The signal 1024 Hz D is supplied 1/32768 seconds or 1/16384 seconds after the 1024 Hz signal is supplied. By using the phase shifted signals 1024 Hz and 1024 Hz D, 2-phase clock signals for the voltage reduction circuit 10 can be obtained as shown in FIG. 4 from AND gates 65,66 (A1,A2). When the output F12 Q of the timer circuit 82 becomes high, namely, when the heavy load circuit is driven or while the timer circuit is driving after the heavy load circuit is released, the outputs of the AND gate 67 (A3) and AND gate 68 (A4) become low as shown in FIG. 4.

Operation of the voltage reduction circuit 10 is now described. When the output A4 is high, the shaded portion in FIG. 4, the N-type MOSFETS 35,36 become conductive and the capacitors 12,13 ($C_AC_B$) are connected in series between the power source terminal $V_{DD}$ and the power source terminal $V_{SS2}$. As the capacitor $C_A$, $C_B$ are of equal size, the battery voltage is divided in half and is outputted. On the other hand, when the output A3 is low, a shaded portion in FIG. 4, the P-type MOSFETS 26,27 become conductive and capacitors $C_B$, $C_A$ are connected in parallel between the power source terminal $V_{DD}$ and $V_{SS1}$ such that the voltage of the charged capacitors is applied as the output $V_{SS1}$.

In FIG. 4 during normal operation when the heavy load circuit is not being driven, and the capacitors $C_A$, $C_B$ are being connected in parallel, the shaded portions of A3 and the shaded portions of A4 appear alternately with a period of 1024 Hz. Thereby, the voltage is reduced by alternately placing the capacitors in series and in parallel. The shaded portions of A3 and A4 are out of phase. Reducing the voltage with a two-phase clock prevents a short circuit between the power sources or a loss of stored charge on the capacitor $C_B$ which would be caused by conduction between transistors 26 and 35, 27 and 36, 35 and 27 or 26 and 36 at the time of changeover between series and parallel connection. Where a voltage reduction circuit is driven with a single-phase clock signal, it has been found from experiment that a current loss of 0.1 to 0.2$\mu$ amperes occurs, but in any particular circuit this current depends on the size of the transistors used for voltage reduction.

On the other hand, when the heavy load circuit, such as the lamp, is on, (curve Sm of FIG. 4), the signal A3 is low (shaded portion), operation of the voltage reduction circuit 10 stops and the capacitors $C_A$, $C_B$ are connected in parallel with each other between $V_{DD}$ and $V_{SS1}$ so as to serve as a capacitative backup to the power source $V_{SS1}$. These capacitors $C_A$, $C_B$ are connected in parallel with each other to $V_{SS1}$ instantaneously when the heavy load circuit is on. And after the heavy load circuit is off, for about a millisecond until the voltage regulation circuit becomes stable, the stored charge in the capacitors $C_A$, $C_B$ is supplied as $V_{SS1}$ by operation of the delay circuit 83. If the capacitors $C_A$, $C_B$ are not connected intantaneously in parallel, but are connected in series between terminals $V_{DD}$ and $V_{SS2}$, a reduced voltage, like So shown in FIG. 2, is outputted as $V_{SS1}$. Thereby, erroneous functioning of the timepiece occurs.

Further, in accordance with this embodiment, after the timer circuit turns off, that is, when operation of the voltage regulation circuit 8 is replaced by that of the voltage reduction circuit 10, it is certain to operate with the capacitor $C_A$ and $C_B$ connected in series so as to minimize voltage change.

The delay circuit 83 provides the above described delay switching from voltage regulation to voltage reduction. Waveforms F13Q and F14Q indicate that signal A5 is supplied with a delay with respect to the signal F12Q. When signal F12Q is low, the voltage regulation circuit 8 is turned on and when A5 becomes high, the power source $V_{SS1}$ is supplied from the voltage regulation circuit 8. The delayed relationship is shown in FIG. 4.

A timer circuit 82 receives a 1 Hz signal as a clock from a flip-flop 10 and delivers the output F12$\bar{Q}$ of low level during normal operation. The output F12$\bar{Q}$ is high and the voltage regulation circuit 8 is driven under the conditions when the lamp or the alarm is on, and also for 1.5 seconds after the alarm or lamp is off. The output F12$\bar{Q}$ is high and the voltage regulation circuit 8 is driven also under the conditions while the no-clock detecting circuit 84 detects the absence of a clock signal and for 1.5 seconds after the circuit 84 is released.

Figure 5:
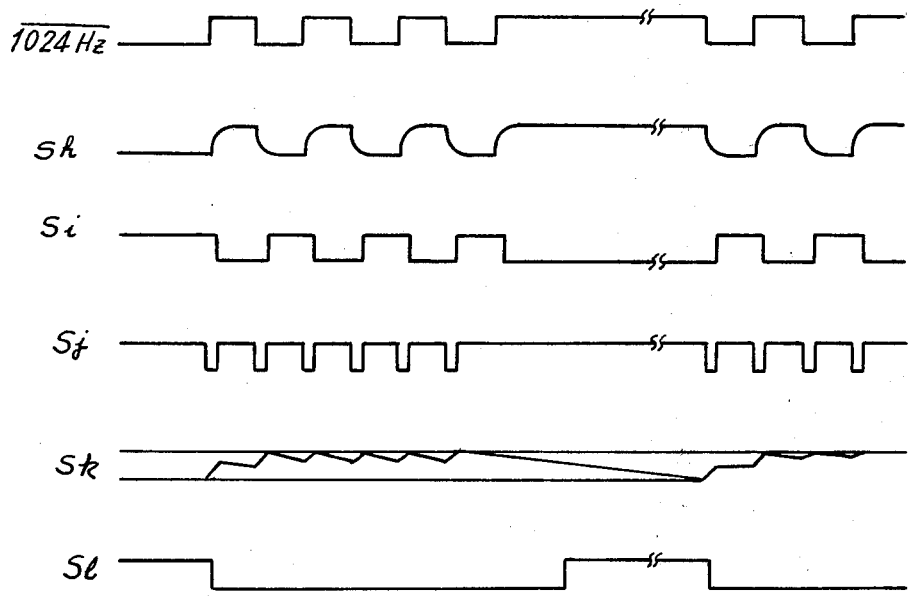
FIG. 5 shows timing waveforms of a no-clock detecting circuit of FIG. 3.

The clock absence or no-clock detecting circuit 84 operates as indicated by the waveforms of FIG. 5. The output signal S1 is normally low but is high when a clock signal is not present.

The voltage regulation circuit 8 is enclosed in broken lines 8 of FIG. 3. The source of a reference voltage includes MOSFETS 18,19,29,30 and a bias circuit, which drives MOSFETS 21,24 with a constant current, includes MOSFETS 20,31. A differential amplifier comprises MOSFETS 21–23, 32, 33, and an amplifier includes MOSFETS 24, 34. MOSFET 25 is a transistor for voltage control in which a depletion mode P-type MOSFET is used as a source follower so as to perform self-feedback. Resistors 85–87 are a voltage dividing network to establish a value of the output voltage.

The reference voltage source uses the difference of threshold voltage $V_{TH}$ between N-type MOSFETS 29,30. This theshold voltage difference is caused by a difference of work function of the gate electrodes between the transistor 29, having a polysilicon gate doped with a P-type impurity, and a transistor 30 having a gate doped with an N-type impurity. Between the drain of FET 19 and $V_{DD}$, a voltage of approximately 1 volt, which is the difference between $V_{TH}$ of FET 29 and $V_{TH}$ of FET 30, appears as a constant reference voltage.

Assuming the reference voltage is $V_{ST}$; the voltage dividng ratio by means of the resistors 85–87 is A; and the output voltage of the voltage regulation circuit is $V_{SS1}$; then the reference voltage can be represented as $V_{ST}=A\times V_{SS1}$. The gate bias on the voltage control FET 25 is automatically set by the output of a differential amplifier so as to keep a balance in the above equation. If $V_{ST}$ is one volt and $V_{SS1}$ is 1.5 volts, which is equal to the output voltage of the voltage reduction circuit 10, then $A=1/1.5$.

In accordance with this embodiment, when the circuit 84 detects the absence of a clock signal, the switching gate 47 conducts and the voltage dividing ratio determined by the resistors 85–87 is modified and A is reduced to 1/1.7. Further, $V_{SS1}$ becomes approximately 1.7 volts which is a little higher than normal voltage. Thereby, the quartz crystal oscillator circuit is improved in its capability for self-starting.

Further, under the heavy load condition when the battery voltage is reduced, the liquid crystal display tends to become indistinct because of a reduction in the effective voltage for driving the liquid crystal display elements. Accordingly, in order to provide a more clear display, it may be necessary to set the output voltage of the voltage regulation circuit 8 a little higher than heretofore described under heavy load conditions, for example, 1.7 volts, to increase the effect of voltage for driving the liquid crystal.

As described above, in accordance with this invention, even when a heavy load circuit such as a lamp or an alarm is driven, and the battery voltage changes by a large amount, stable voltage is supplied to the timepiece circuits. Further, for normal operation, improved efficiency is obtained in voltage reduction. Therefore, a timepiece which has a long battery life and has no operational malfunctions is provided.

Although in the embodiment described above the electronic timepiece uses a lithium battery, it should be understood that this invention is not limited only to an electronic timepiece using a lithium battery but also is applicable to electronic timepieces using any battery having a relatively high voltage.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. In electronic timepiece including a time standard signal generating circuit, divider circuit means receiving said standard signal and outputting timekeeping signals of lower frequency, display means indicating at least timekeeping data, and a source of voltage, and at least one heavy load circuit intermittently operating and drawing a current from said voltage source, said heavy load current being large in comparison with normal operating current for timekeeping, the improvement therein comprising:

a voltage reduction circuit, said reduction circuit providing a voltage output which is a division of said source voltage;

a voltage regulation circuit, said regulation circuit providing a constant voltage output;

power control circuit means for selecting one of said voltage reduction and voltage regulation circuits to provide voltage input to said timekeeping circuits, said regulation circuit being selected when said at least one heavy load circuit operates, said reduction circuit being selected when said at least one heavy load circuit is inoperative; and means for detecting operation of said at least one heavy load circuit.

2. An electronic timepiece as claimed in claim 1, wherein said voltage reduction circuit includes capacitors switched from parallel connection to series connection to divide the potential of said voltage source.

3. An electronic timepiece as claimed in claim 2, wherein said voltage regulation circuit output equals the voltage reduction circuit output.

4. An electronic timepiece as claimed in claim 2, wherein MOS transistors are adapted to perform said switching.

5. An electronic timepiece as claimed in claim 2, wherein said voltage regulation circuits include MOS transistors.

6. An electronic timepiece as claimed in claim 3, wherein the capacitors are of equal size and said reduced voltage is one-half of said source voltage.

7. An electronic timepiece as claimed in claim 1, wherein said constant voltage does not exceed said source voltage.

8. An electronic timepiece as claimed in claim 2 or 3, and further comprising timer means, said timer means being adapted for actuation for a preselected time period by the turning on of said at least one heavy load circuit, said selection of said voltage reduction circuit by said power control circuit means after operation of said at least one heavy load circuit is completed, subject to deactivation of said timer means, whereby timekeeping on said voltage reduction circuit is delayed permitting said power source to stablize.

9. An electronic timepiece as claimed in claim 2, wherein said power control circuit means is adapted to connect said capacitors in parallel across said output of said voltage regulation circuit when said at least one heavy load circuit begins to operate, said capacitors already being charged at the time of said connection, whereby said capacitors back up and stabilize said voltage regulation circuit output.

10. An electronic timepiece as claimed in claim 1 or 2, and further comprising means to detect signal generation or non-signal generation by said time standard signal generating circuit, said power control circuit means being adapted to select said voltage regulation circuit when said signal generation detector means indicates non-generation of a frequency signal by said standard signal generator circuit.

11. An electronic timepiece as claimed in claim 10, wherein said means to detect signal generation operates on a low frequency clock signal produced by division of said time standard signal.

12. An electronic timepiece as claimed in claim 10, wherein said voltage regulation circuit includes variable means for determining the level of voltage output from said voltage regulation circuit.

13. An electronic timepiece as claimed in claim 12, wherein said voltage regulation circuit is adapted to increase the level of output voltage in response to said means to detect signal generation detecting non-generation, said voltage level response to non-generation exceeding the voltage level in response to operation of said at least one heavy load circuit.

14. An electronic timepiece as claimed in claim 12, wherein said variable means includes a voltage divider of adjustable elements.

15. An electronic timepiece claimed in claim 14, wherein said voltage divider elements comprise resistors.

16. An electronic timepiece as claimed in claim 3, wherein a portion of said switching MOS transistors are arranged in two complementary pairs, each gate of one pair being driven in common with a gate of the other pair, independent driving signals for the common gates being of the same switching frequency, the leading and trailing edges of said independent driving signals being phase-shifted, one to the other.

* * * * *